US010828912B2

(12) United States Patent
Ohnishi

(10) Patent No.: US 10,828,912 B2
(45) Date of Patent: Nov. 10, 2020

(54) PRINTING METHOD, PRINTING DEVICE, AND PRINTING SYSTEM

(71) Applicant: MIMAKI ENGINEERING CO., LTD., Nagano (JP)

(72) Inventor: Masaru Ohnishi, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 16/045,643

(22) Filed: Jul. 25, 2018

(65) Prior Publication Data

US 2019/0039389 A1 Feb. 7, 2019

(30) Foreign Application Priority Data

Aug. 3, 2017 (JP) ..... 2017-150703

(51) Int. Cl.
*B41J 11/00* (2006.01)
*B41J 2/21* (2006.01)
(Continued)

(52) U.S. Cl.
CPC ..... *B41J 11/002* (2013.01); *B41J 2/2103* (2013.01); *B41J 3/4078* (2013.01);
(Continued)

(58) Field of Classification Search
CPC ..... B41J 11/002; B41J 3/4078; B41J 2/2103; B41M 5/0064; B41M 5/0011;
(Continued)

(56) References Cited

U.S. PATENT DOCUMENTS 4,702,742 A 10/1987 Iwata et al.
2015/0158304 A1* 6/2015 Kida ..... B41J 2/16552 347/33
2016/0177112 A1* 6/2016 Sakaguchi ..... B41M 7/009 427/553

FOREIGN PATENT DOCUMENTS

EP 1683645 7/2006
EP 3101173 12/2016
(Continued)

OTHER PUBLICATIONS

"Search Report of Europe Counterpart Application", dated Dec. 19, 2018, p. 1-p. 16.

(Continued)

*Primary Examiner* — Yaovi M Ameh
(74) *Attorney, Agent, or Firm* — JCIPRNET

(57) ABSTRACT

A wider variety of printing is performed more appropriately using ink that generates heat by energy radiation. A printing method of performing a printing on a medium using a color ink includes a water-soluble ink layer forming step of forming a water-soluble ink layer that is a layer of ink that becomes water-soluble after fixing, a color ink layer forming step of ejecting the color ink to the medium to form a color ink layer that is a layer of the color ink, and a water-soluble ink layer removing step of removing the water-soluble ink layer. The color ink includes a colorant and a solvent and generates heat by radiation of an energy ray. In the color ink layer forming step, the energy ray is emitted to the color ink after ink droplets landing to remove by evaporation at least a part of the solvent included in the color ink.

13 Claims, 4 Drawing Sheets

(51) Int. Cl.

| | |
|---|---|
| ***B41M 5/00*** | (2006.01) |
| ***B41M 7/00*** | (2006.01) |
| ***D06P 5/30*** | (2006.01) |
| ***B41J 3/407*** | (2006.01) |

(52) U.S. Cl.
CPC ..... *B41M 5/0011* (2013.01); *B41M 5/0047* (2013.01); *B41M 5/0064* (2013.01); *B41M 7/0009* (2013.01); *B41M 7/0036* (2013.01); *B41M 7/0081* (2013.01); *D06P 5/30* (2013.01)

(58) Field of Classification Search
CPC ..... B41M 5/0047; B41M 7/0036; B41M 7/0009; B41M 7/0081; D06P 5/30
See application file for complete search history.

(56) References Cited

FOREIGN PATENT DOCUMENTS

| | | |
|---|---|---|
| JP | 2010174391 | 8/2010 |
| JP | 2017128039 | 7/2017 |
| JP | 2017128040 | 7/2017 |
| WO | 2017135425 | 8/2017 |

OTHER PUBLICATIONS

"Search Report of Europe Counterpart Application", dated May 10, 2019, p. 1-p. 15.

* cited by examiner

PRINTING METHOD, PRINTING DEVICE, AND PRINTING SYSTEM

CROSS REFERENCE TO RELATED APPLICATIONS

This application claims the priority benefit of Japanese Patent Application No. 2017-150703, filed on Aug. 3, 2017. The entirety of the above-mentioned patent application is hereby incorporated by reference herein and made a part of this specification.

TECHNICAL FIELD

The present disclosure relates to a printing method, a printing device, and a printing system.

BACKGROUND ART

Conventionally, inkjet printers performing inkjet printing have been widely used. One of inks widely used in inkjet printers is evaporation-drying (evaporation-drying and fixing) ink that fixes on a medium through evaporation of a solvent therein. The inventor of the subject application has conceived of rapidly evaporating a solvent in ink by directly heating by ultraviolet radiation for evaporation-drying inks. The inventor has filed a patent application for such a configuration (for example, see PCT/JP2017/004025). The configuration disclosed in PCT/JP2017/004025, for example, can appropriately perform printing on a variety of media.

Patent Literature: PCT/JP2017/004025

SUMMARY

The method disclosed in Patent Literature PCT/JP2017/004025 is an effective method for solving the problem of conventional evaporation-drying inks. It is therefore desired to make use of the merits of this method to perform a variety of printing. The present disclosure provides a printing method, a printing device, and a printing system capable of solving the problem above.

After filing the application of Patent Literature PCT/JP2017/004025, the inventor of the subject application has made further elaborate studies on the method of heating ink directly by radiation of energy rays such as ultraviolet rays (hereinafter referred to as fast-drying method). In the elaborate studies, the inventor has examined more preferable methods in printing, for example, on fabric media (for example, textile).

In this respect, for example, in the field of signage graphics using flags and in the field of apparel or textile in which printing is performed on clothing such as uniforms, sublimation transfer printing on non-pretreated textile has been put into practice. In a widely used method in sublimation transfer printing, water-based sublimation ink is printed on transfer paper and then heat-transferred onto cloth superimposed on the transfer paper. In the field of signage graphics, direct sublimation printing is also common. In this case, water-based sublimation ink is printed on pretreated cloth (for example, polyester cloth) coated with a pretreatment agent effective in preventing bleeding, and the ink is heated for color development. In the field of digital textile printing technology, methods using dye inks including reactive dye and acid dye have been in practical use. In this case, for example, textiles pretreated with an auxiliary for helping color development of dye and/or a paste for preventing bleeding of ink are used as media. Such techniques have been widely used in the field of textiles with recent development of high-speed inkjet printers.

Unfortunately, the printing by conventional methods have various problems as described below. For example, the sublimation transfer printing requires printing on transfer paper and may lead to high running costs. A heat roller for transfer and a heat press machine are also necessary, which may increase an initial investment in facilities. Moreover, in this case, the moisture included in ink may cause swelling, curing, or cockling of transfer paper, which may result in deformation of an image, uneven density, or uneven color. When the direct sublimation printing is used for printing, for example, coating of a pretreatment agent (for example, paste) is necessary to prevent bleeding on polyester cloths, which may increase the costs. In this case, it is difficult for users to use clothes available at hand as they are. The printing using dye inks including reactive dye or acid dye also requires pretreatment on fabric or other media, which may increase the costs. Also in this case, it is difficult for users to use clothes available at hand as they are. The pretreatment on fabric or other media is typically handled by professionals having special facilities. This may take much time for preparation and cost much. Such special facilities are often designed for rolled textiles. It is therefore difficult to applied to, for example, the usage in which personal users perform pretreatment on fabrics available at hand.

By contrast, when ink for the fast-drying method (fast-drying ink) is used, printing can be performed on non-pretreated fabric or other media appropriately while bleeding is prevented. In this case, direct printing can be performed without performing transfer.

The inventor of the subject application has conducted elaborate studies on the printing operation performed using fast-drying ink and conceived of performing printing by not merely forming a layer of fast-drying ink but combining a layer of ink that becomes water-soluble after fixing. The inventor has found that this enables a variety of printing to be performed appropriately on media. The inventor has conducted further elaborate studies to find features necessary for achieving such effects. This finding has led to completion of the present disclosure.

In order to solve the above-noted problem, the present disclosure provides a printing method of performing a printing on a medium using a color ink, which is an ink having a color. The printing method includes: a water-soluble ink layer forming step of forming a water-soluble ink layer that is a layer of ink that becomes water-soluble after fixing; a color ink layer forming step of ejecting the color ink to the medium to form a layer of the color ink; and a water-soluble ink layer removing step of removing the water-soluble ink layer. The color ink includes a colorant and a solvent, and the color ink generates heat by radiation of an energy ray. In the color ink layer forming step, the energy ray is emitted to the color ink after ink droplets landing to remove by evaporation at least a part of the solvent included in the color ink.

In such a configuration, for example, an ink that generates heat by radiation of energy rays is used as a color ink and, the ink can be directly heated. For example, this configuration sufficiently can increase the viscosity of ink immediately after landing of ink droplets onto a medium and prevent bleeding appropriately. In this case, the printing speed can also be increased appropriately, because it is possible to prevent appropriately bleeding of ink.

In this case, since a water-soluble ink layer is formed in addition to a layer of color ink, printing can be performed in a state different from when only a layer of color ink is formed. This enables, for example, a wider variety of printing using ink that generates heat by energy radiation. In this case, a water-soluble ink layer is formed as a layer other than a layer of color ink, and the water-soluble ink layer is removed appropriately in the water-soluble ink layer removing step. Thus, for example, a variety of printing can be performed appropriately using a layer of ink that is not left on the medium after finishing of printing.

In this configuration, the color ink is, for example, evaporation-drying ink that fixes on the medium through evaporation of the solvent. In this configuration, in addition to the operation of each step described above, a process of the color development step may be performed to color the medium with the color ink. In this case, the process of the color development step can be considered as, for example, a process of developing the color in the medium with the color ink. In the color development step, the color is developed by, for example, dispersing the color ink in the medium through the water-soluble ink layer. For example, a dye ink including a dye as a colorant that is developed through a predetermined color development process can be suitably used as the color ink. In this case, in the color development step, for example, a process of developing the dye is performed as a process for coloring the medium with the color ink. More specifically, in this case, in the color development step, for example, before the water-soluble ink layer is removed in the water-soluble ink layer removing step, a predetermined color development process such as heating and steam heating is performed to develop the dye. With such a configuration, for example, printing using color ink can be performed appropriately.

The water-soluble ink layer is removed, for example, through a washing process in the water-soluble ink layer removing step before printing is finished. With such a configuration, for example, when color ink not adhering to the medium does not react, the unreacted color ink is removed appropriately together with the water-soluble ink layer. This prevents, for example, contamination or surface roughness of the medium due to the color ink left on the surface of the medium in an inappropriate state. For example, transparent ink such as clear ink is preferably used as ink for forming the water-soluble ink layer. Such a configuration can appropriately prevent, for example, the color of the ink for forming the water-soluble ink layer from affecting the print result. When a dye is used as a colorant in the color ink and is developed through a color development process, for example, a layer that serves some function during the color development process may be formed as the water-soluble ink layer. More specifically, in this case, color ink may be ejected on the water-soluble ink layer in the color ink layer forming step, and the dye passing through the water-soluble ink layer may adhere to the medium in the color development step. Such a configuration enables, for example, coloring with the color ink in a state different from when an image is directly drawn on the medium using color ink. For example, a variety of printing thus can be performed more appropriately. More specifically, in the color development step, for example, heating or steam heating is performed to develop the dye. The dye disperses in the water-soluble ink layer and passes through the water-soluble ink layer to adhere to the medium.

Here, the dye passing through the water-soluble ink layer means, for example, that the molecules of the dye pass through the water-soluble ink layer during heating in the color development process and reach the medium. Then, in this case, it is preferable that dye that easily passes through the water-soluble ink layer, for example, dye composed of a substance with a small molecular weight, be used as the dye included in the color ink. For example, a sublimation dye or a disperse dye can be suitably used as such a dye.

When printing is performed using dye, the dye may be partially not developed appropriately in the color development process. Then, in this case, if the undeveloped dye is left on the medium, the surface of the medium may give an impression of being coarse. By contrast, in the configuration described above, for example, in the water-soluble ink layer removing step, the water-soluble ink layer can be removed together with the dye not adhering to the medium. For example, the undeveloped dye thus can be removed appropriately.

The layer of color ink may be formed prior to the water-soluble ink layer. In this case, the layer of color ink is formed in the color ink layer forming step before the water-soluble ink layer is formed in the water-soluble ink layer forming step. In the water-soluble ink layer forming step, the water-soluble ink layer is formed on the layer of color ink. In this case, for example, ink including a substance for color development, such as an auxiliary (color development auxiliary) for helping development of the dye, may be used as the water-soluble ink that is ink for forming the water-soluble ink layer. In this case, the substance for color development is, for example, a substance to be used for developing the dye in the color development process. In this case, the color development step can be considered as, for example, a step of developing the dye using a substance for color development. When an auxiliary is used as the substance for color development, for example, the substance for color development can be considered as a substance that helps the reaction between the dye and the medium during the color development process. In such a configuration, for example, the dye can be developed appropriately in the color development process. In this case, after the dye is developed in the color development step, the water-soluble ink layer is removed in the water-soluble ink layer removing step.

In such a configuration, the water-soluble ink layer can be considered as a layer having the function of helping development of the dye. Also in this case, since the water-soluble ink layer is formed in addition to the layer of color ink, printing can be performed in a state different from when only a layer of color ink is formed. Therefore, in such a configuration, a wider variety of printing can be performed, for example, using an ink that generates heat by energy radiation.

In this configuration, for example, a fabric medium (for example, textile) may be used as the medium. In this case, for example, a fabric medium not subjected to pretreatment for preventing bleeding can be suitably used. In light of performing a wider variety of printing, a medium other than fabric media may be used as the medium. In this case, for example, a variety of plastic media may be used.

More specifically, for example, an ink that generates heat by ultraviolet radiation may be used as the color ink. In this case, ultraviolet rays are emitted as energy rays in the color ink layer forming step. This increases the viscosity of the color ink, for example, to such a degree that bleeding substantially does not occur on the medium. In this case, that bleeding substantially does not occur means, for example, that bleeding that becomes a problem in the desired quality of printing does not occur. In this case, for example, an ultraviolet light-emitting diode (UV LED) can be suitably used as a light source for generating ultraviolet rays.

Another aspect of the present disclosure provides a printing device and a printing system having the similar features as described above. In these cases, for example, the similar effects as described above can be achieved. When the present disclosure is focused on the feature of the combination of the layer of color ink with the water-soluble ink layer, an ink other than ink that generates heat by energy radiation may be used.

According to the present disclosure, a wider variety of printing can be performed more appropriately, for example, using ink that generates heat by energy radiation.

BRIEF DESCRIPTION OF THE DRAWINGS

FIGS. 1A and 1B are diagrams illustrating an exemplary printing device 10 according to an embodiment of the present disclosure, in which FIGS. 1A and 1B are a top view and a side cross-sectional view, respectively, of an exemplary configuration of the main part of the printing device 10.

DESCRIPTION OF EMBODIMENTS

Figure 1A:
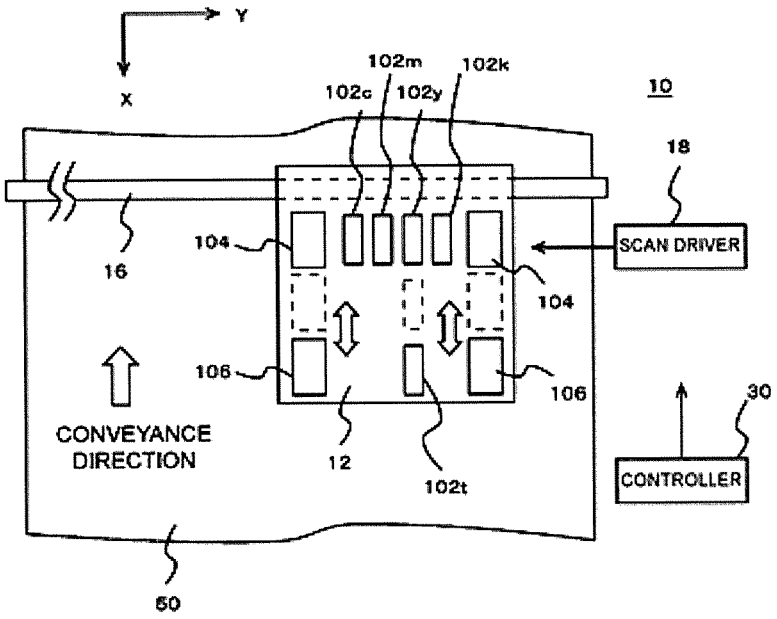
Figure 1B:
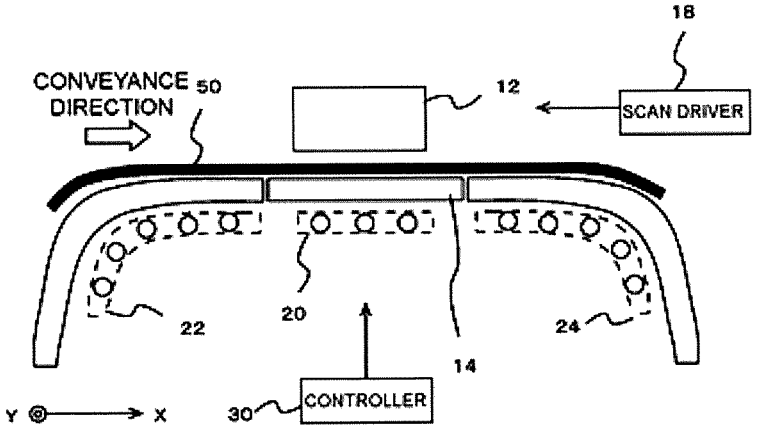

Embodiments according to the present disclosure will be described below with reference to the figures. FIGS. 1A and 1B illustrate an exemplary printing device 10 according to an embodiment of the present disclosure. FIGS. 1A and 1B are a top view and a side cross-sectional view, respectively of an exemplary configuration of the main part of the printing device 10.

The printing device 10 may have the same or similar features as known printing devices, except for the points described below. For example, the printing device 10 may further include the same or similar components as those in known printing devices, in addition to the components described below. In this example, the printing device 10 is an example of a device included in a printing system. More specifically, in the configuration illustrated in FIGS. 1A and 1B, the printing device 10 constitutes a printing system together with a color developer described later. In a modified configuration of the printing system, for example, the printing system may include the printing device 10 alone.

The printing device 10 in this example will be described in more detail below. In this example, the printing device 10 is an inkjet printer that performs inkjet printing on a medium 50 to be printed. In this example, a fabric medium (for example, textile) is used as a medium 50. In this case, for example, media such as fabrics not subjected to pretreatment for preventing bleeding or the like (pretreatment-free fabrics) are suitably used. The printing device 10 includes a head 12, a platen 14, a guide rail 16, a scan driver 18, a print heater 20, a pre-heater 22, and an after heater 24.

The head 12 ejects ink to a medium 50 and has a plurality of inkjet heads and a plurality of UV light sources. More specifically, in this example, as illustrated in FIG. 1A, the head 12 includes an inkjet head 102*c*, an inkjet head 102*m*, an inkjet head 102*y*, an inkjet head 102*k*, and an inkjet head 102*t* as a plurality of inkjet heads. Among these, the inkjet head 102*c*, the inkjet head 102*m*, the inkjet head 102*y*, and the inkjet head 102*k* (hereinafter referred to as inkjet heads 102*c* to 102*k*) are an example of inkjet heads ejecting color ink, which is ink having a color. In this example, as illustrated in the figure, the inkjet heads 102*c* to 102*k* are aligned in the X direction preset in the printing device 10 and disposed side by side in the Y direction orthogonal to the X direction. In this case, the X direction is a direction parallel to the feeding direction (conveyance direction) in which a medium 50 is moved relative to the head 12. The Y direction is a direction parallel to the main scanning direction in which the head 12 is moved relative to a medium 50 during main scanning operation. In this case, the main scanning operation refers to, for example, the operation of ejecting ink while moving in the main scanning direction.

Here, in this example, the color ink refers to, for example, ink for coloring for representing an image to be printed. The color ink may be considered, for example, as ink of basic colors (process colors) for use in full color printing. More specifically, the inkjet head 102*c* ejects cyan (C) ink. The inkjet head 102*m* ejects magenta (M) ink. The inkjet head 102*y* ejects yellow (Y) ink. The inkjet head 102*k* ejects black (K) ink. In this example, the inkjet heads 102*c* to 102*k* each eject dye ink containing dye as a colorant that is developed through a predetermined color development process. In this case, the color of ink refers to, for example, the color after the color development process. The color ink used in the inkjet heads 102*c* to 102*k* is ink for coloring a fabric medium 50. Therefore, this color ink may be considered as ink for textile printing on a fabric medium 50 (textile ink).

In this example, evaporation-drying ink is used as color ink to be ejected from the inkjet heads 102*c* to 102*k*. Ink that generates heat per se by ultraviolet radiation is used as the evaporation-drying ink. In this case, for example, ultraviolet rays are emitted to the ink adhering to the medium 50 to dry the ink appropriately for a short time. The ink thus can be dried appropriately, for example, before bleeding of ink occurs.

The color ink for use in this example may be considered as, for example, fast-drying ink that includes a colorant and a solvent and generates heat by energy radiation. In this case, generating heat by energy radiation means, for example, absorbing energy rays to generate heat. For example, ink containing an energy absorber that absorbs energy rays can be used as such ink. As in this example, for example, when ultraviolet rays are used as energy rays, an ink containing an UV absorber may be used. Depending on the color and the compositions of ink, an energy absorber is not added intentionally to allow the ink to generate heat. More specifically, for example, when the ink contains a colorant that sufficiently absorbs energy rays emitted to the ink, the colorant absorbs energy rays to cause the ink to generate heat. The features of the color ink for use in this example will be described in more detail later.

The inkjet head 102*t* ejects clear ink, which is ink of clear color. In this case, the clear color refers to, for example, colorless transparent color. Colorless ink means, for example, ink considered as being colorless in design. The clear ink may also be considered as, for example, ink that does not contain a colorant. The clear ink may also be considered as an example of light-transmitting ink, which is an ink that allows light to pass through. The inkjet head 102*t* may also be considered as, for example, an inkjet head that ejects ink of a color other than basic colors C, M, Y, and K.

In this example, for example, as illustrated in FIG. 1A, the inkjet head 102*t* is disposed so as to be displaced from the inkjet heads 102*c* to 102*k* in the X direction. In this example, fast-drying ink that generates heat per se by ultraviolet radiation is also used as clear ink ejected from the inkjet head 102*t*. Further, water-soluble ink that becomes water-soluble after fixing is used as clear ink. In this case, becoming water-soluble after fixing means, for example, that a layer of ink formed using the ink can be removed by washing with water in a state in which the ink is sufficiently dried and fixed on the medium 50. In this case, a layer of ink formed of clear ink can be considered as an example of the water-soluble ink layer that is a layer of ink that becomes water-soluble after fixing. The water-soluble ink layer may be considered as, for example, a water-soluble coating formed on a medium 50.

A plurality of UV light sources in the head 12 are light sources (UV radiation means) generating ultraviolet rays to cause ink to generate heat. In this example, as illustrated in FIG. 1A, the head 12 includes a plurality of UV light sources 104 and a plurality of UV light sources 106, as a plurality of UV light sources. Ultraviolet light-emitting diodes (UV LEDs) (UV LED radiation means) are used as the UV light sources 104 and the UV light sources 106. With such a configuration, for example, ultraviolet rays to be emitted to ink can be generated appropriately with high efficiency.

The UV light sources 104 emit ultraviolet rays to the ink ejected by the inkjet heads 102*c* to 102*y*. The UV light sources 104 are aligned with the inkjet heads 102*c* to 102*y* in the X direction and disposed on one side and the other side of the arrangement of the inkjet heads 102*c* to 102*y* in the Y direction. The UV light source 104 emits ultraviolet rays to the ink adhering to the medium 50 in each main scanning operation. In this case, for example, ultraviolet rays are emitted from the UV light source 104 on the rear side of the inkjet heads 102*c* to 102*y* in the moving direction of the head 12, so that the color ink is irradiated with ultraviolet rays immediately after landing on the medium 50, thereby sufficiently increasing the viscosity of ink before bleeding of ink occurs. This example thus can prevent, for example, bleeding of color ink.

Here, the color ink is dried by the UV light source 104, for example, to a degree that sufficiently increases the viscosity of ink in a range in which the purpose of preventing bleeding is achieved. Therefore, ultraviolet radiation by the UV light source 104 can be considered as, for example, the operation of emitting ultraviolet rays to color ink adhering to the medium 50 to remove by evaporation at least part of a solvent included in the color ink. In this example, ink can be directly heated by drying the ink using the UV light source 104, unlike a case where ink is indirectly heated by heating the medium 50 with a general heater. This example therefore, for example, can sufficiently increase the viscosity of color ink for a short time immediately after ink droplets land on the medium 50 and appropriately prevent bleeding. In this case, since bleeding of ink is prevented appropriately, for example, the speed of printing can be increased appropriately.

When ink is heated with the UV light source 104, color ink is directly heated, for example, such that the temperature of the color ink on the medium 50 becomes higher than the temperature of the medium 50. More specifically, in this case, for example, the color ink may be heated to the temperature at which the color ink on the medium 50 boils. Boiling of the color ink on the medium 50 means, for example, that the solvent in the ink boils. This configuration, for example, can increase the viscosity of the color ink on the medium 50 more appropriately for a short time. For example, this also can prevent bleeding more appropriately. In this case, for example, ink can be heated efficiently, which leads to, for example, reduction of power consumption necessary for drying ink.

A plurality of UV light sources 106 emit ultraviolet rays to the ink ejected by the inkjet head 102*t*. The UV light sources 106 are aligned with the inkjet head 102*t* in the X direction and disposed on one end and the other end of the inkjet head 102*t* in the Y direction. The UV light source 106, for example, emits ultraviolet rays to clear ink adhering to the medium 50 in each main scanning operation. Preferably, a plurality of UV light sources 106 can be changed in position in the X direction, for example, as indicated by the arrows in the figure. This configuration enables, for example, adjustment of the time from landing of ink to radiation of ultraviolet rays. For example, when a layer of clear ink is formed, the time taken to dry ink can be adjusted more appropriately.

In the head 12 in this example, the part including the inkjet heads 102*c* to 102*y* and the UV light sources 104 functions as a configuration for forming a layer of color ink, as described above. Therefore, the part in the head 12 that includes the inkjet heads 102*c* to 102*y* and the UV light sources 104 can be considered as, for example, an example of the color ink layer-former. The part in the head 12 that includes the inkjet head 102*t* and the UV light sources 106 functions as a configuration for forming a layer of clear ink that is a layer of water-soluble ink. Therefore, the part in the head 12 that includes the inkjet head 102*t* and the UV light sources 106 can be considered, for example, as an example of the water-soluble ink layer-former.

The platen 14 is a table-shaped member for supporting the medium 50 and supports the medium 50 such that the medium 50 is opposed to the head 12. In this example, the platen 14 accommodates the print heater 20, the pre-heater 22, and the after heater 24 inside. The guide rail 16 is a rail member for guiding the movement of the head 12 during main scanning operation.

The scanning driver 18 drives the main scanning operation and the sub scanning operation by the printing device 10. During main scanning operation, for example, the scanning driver 18 allows the inkjet heads in the head 12 to eject ink in accordance with an image to be printed while moving the head 12 along the guide rail 16. The region of the medium 50 opposed to the head 12 is changed by driving the sub scanning operation in the interval between main scanning operations. In this case, the sub scanning operation refers to, for example, the operation of moving the medium 50 in the sub scanning direction relative to the head 12. In this example, the sub scanning direction is a direction parallel to the X direction. The scanning driver 18, for example, drives a not-illustrated roller to move the medium 50 in the conveyance direction parallel to the sub scanning direction, thereby driving the sub scanning operation.

The print heater 20 heats the medium 50 at a position opposed to the head 12. The use of the print heater 20 enables, for example, more efficient heating of the ink on the medium 50. When the heating temperature in the print heater 20 is high, for example, the inkjet heads in the head 12 are heated, which is likely to cause nozzle clogging or other problems. In this respect, in this example, ink can be efficiently heated using the UV light source 104 as described above. The heating temperature by the print heater 20 is preferably set to a sufficiently low temperature, for example, for the purpose of reducing the effect of the environment temperature. More specifically, the temperature for heating the medium 50 by the print heater 20 is, for example, 40° C. or lower, preferably 35° C. or lower. This configuration, for example, can appropriately reduce the effect of environment temperature while preventing nozzle clogging or other problems.

The pre-heater 22 heats the medium 50 upstream from the head 12 in the conveyance direction. The pre-heater 22 can be used to appropriately adjust the initial temperature of the medium 50 before the medium 50 reaches the position of the head 12. In this case, the temperature for heating the medium 50 by the pre-heater 22 is preferably set to a sufficiently low temperature (for example, 40° C. or lower, preferably 35° C. or lower), for example, for the purpose of reducing the effect of environment temperature.

The after heater 24 is a heater (post-heating heater) for heating the medium 50 downstream from the head 12 in the conveyance direction. The use of the after heater 24 ensures that ink is dried, for example, until the printing is finished. The heating temperature of the after heater 24 may be set to a high temperature to some degree in a range equal to or lower than the heat-resistant temperature of a medium 50 to be used. More specifically, the temperature for heating a medium 50 by the after heater 24 is set to, for example, about 30 to 50° C.

As described above, in this example, ink is dried using the UV light sources 104 and others. In this case, prevention of bleeding and drying for a layer of ink are mainly performed by ultraviolet radiation by the UV light sources 104 and others. Therefore, all or some of the print heater 20, the pre-heater 22, and the after heater 24 may be omitted depending on the use environment of the printing device 10 and the desired quality of printing. Various known heating means can be used as the print heater 20, the pre-heater 22, and the after heater 24. More specifically, for example, electric heaters, hot air heaters, and infrared heaters can be suitably used as the print heater 20, the pre-heater 22, and the after heater 24. In this example, the print heater 20, the pre-heater 22, and the after heater 24 can be considered as, for example, auxiliary drying means.

A controller 30 is, for example, a CPU of the printing device 10 for controlling the operation of each portion in the printing device 10. In this example, for example, printing on a medium 50 can be performed appropriately. The specific configuration of the printing device 10 is not limited to the configuration illustrated in FIGS. 1A and 1B and may be modified in various ways. For example, for inks to be used, inks of the colors red (R), green (G), and blue (B) may be additionally used. As special color inks, inks of various colors, such as pearl colors, metallic colors, fluorescent colors, and phosphorescent colors may be used.

The features of the ink for use in this example will now be described in more detail. As described above, in this example, the inks of colors to be used in the inkjet heads in the head 12 (for example, the inkjet heads 102*c* to 102*k*) are inks that generate heat by ultraviolet radiation. In this case, an example of the UV light sources 104 and the UV light sources 106 is a UV LED that generates ultraviolet rays in the wavelength region of about 250 to 400 nm. When a UV LED is used, the energy of ultraviolet rays emitted from the UV light source, for example, is set such that the integrated value of radiation energy in one pass or a plurality of passes in the multi-pass method is about 300 to 3000 mJ/cm$^2$. In this case, in order to allow ink to generate heat sufficiently in response to such ultraviolet rays, for example, it is preferable to use such an ink that the absorption ratio of ultraviolet rays is 10% or more when a 20 μm-thick layer of ink is formed.

In this case, in order to allow ink to generate heat more efficiently, for example, ink containing a UV absorber that absorbs ultraviolet rays may be used. In this case, preferable examples of the ink may be an ink in which a resin having an organic UV absorber dissolved therein is dispersed in a solvent or an ink having an organic UV absorber directly dissolved in a solvent. For example, a substance colorless transparent or almost colorless transparent that does not affect the color of the ink is preferably used as a UV absorber. More specifically, in this case, for example, it is preferable to use a substance that is almost transparent in the visible light wavelength range and exhibits a large absorption in the vicinity of the emission wavelengths (for example, about 250 to 400 nm) of the UV LED used as the UV light source 104 or the UV light source 106. In this case, the UV LED used as the UV light source 104 or the UV light source 106 may preferably have emission wavelengths equal to or lower than 400 nm and have the maximum emission wavelength in a wavelength range that overlaps the effective absorption wavelengths of the UV absorber. For example, a variety of substances used as the components of known UV-curable inks may be used as the UV absorber.

The printing operation performed using the printing device 10 in this example will now be described in more detail. FIGS. 2A to 2E are diagrams illustrating an exemplary printing operation performed in this example. FIGS. 2A to 2E schematically illustrate operation in each step during printing. In FIGS. 2A to 2E, the inkjet heads 102*c* to 102*k* for color inks (see FIGS. 1A and 1B) are collectively depicted as a single unit as illustrated in FIG. 2B for convenience of illustration.

In the printing operation illustrated in FIGS. 2A to 2E, a fabric medium such as textile is used as the medium 50. Therefore, this printing operation can be considered as, for example, the operation of dyeing fabric. As described above, in this example, fast-drying inks are used as color inks ejected from the inkjet heads 102*c* to 102*k* and clear ink ejected from the inkjet head 102*t* (see FIGS. 1A and 1B). More specifically, ink that generates heat by ultraviolet radiation is used as these fast-drying inks. In this example, in addition to a layer of color ink formed using color ink, a water-soluble ink layer is further formed using water-soluble clear ink. In this case, printing is performed in a state different from, for example, when only a layer of color ink is formed.

Figure 2A:
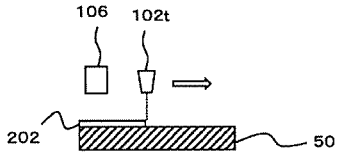
FIGS. 2A to 2E are diagrams illustrating an example of printing operation performed in this example and schematically illustrate operation in each step during printing.
Figure 2B:
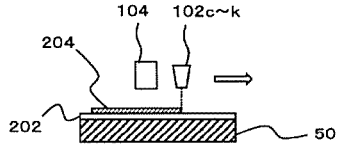

More specifically, in the printing operation illustrated in FIGS. 2A to 2E, for example, as illustrated in FIG. 2A, a water-soluble ink layer 202 that is a layer of water-soluble clear ink is formed on a medium 50, such as fabric, not subjected to pretreatment, using the inkjet head 102*t* and the UV light source 106. In this case, for example, in the main scanning operation, the inkjet head 102*t* and the UV light source 106 are moved in the main scanning direction as indicated by the arrow in the figure to form the water-soluble ink layer 202 on the medium 50. Ultraviolet rays are emitted from the UV light source 106 to the clear ink ejected from the inkjet head 102*t* to fix the water-soluble ink layer 202 on the medium 50. In this case, the operation of forming the water-soluble ink layer 202 is an example of the operation of the water-soluble ink layer forming step. The water-soluble ink layer 202 can be considered as, for example, an undercoat layer on which another layer of ink is to be formed.

After the water-soluble ink layer 202 is formed, for example, as illustrated in FIG. 2B, a color ink layer 204 is formed on the water-soluble ink layer 202 using the inkjet heads 102*c* to 102*k* and the UV light source 104. In this case, for example, in the main scanning operation, the inkjet heads 102*c* to 102*k* and the UV light source 104 are moved in the main scanning direction indicated by the arrow in the figure to form the color ink layer 204 on the water-soluble ink layer 202. Ultraviolet rays are emitted from the UV light source 104 to the color inks (inks of C, M, Y, and K colors) ejected from the inkjet heads 102*c* to 102*k* to fix the color ink layer 204 on the water-soluble ink layer 202. In such a configuration, for example, the UV light source 104 emits ultraviolet rays to the color inks ejected from the inkjet heads 102*c* to 102*k* to sufficiently increase the viscosity of ink of each color before bleeding (for example, bleeding of colors) occurs. The color ink layer 204 is thus fixed on the medium 50 with the water-soluble ink layer 202 interposed. In this case, the color ink layer 204 is an example of the layer of color ink. The operation of forming the color ink layer 204 is an example of the operation of the color ink layer forming step of ejecting color ink to the medium 50 to form a layer of color ink.

Here, as described above, in this example, dye ink including dye as a colorant is used as color ink. As will be described below, in the printing operation illustrated in FIGS. 2A to 2E, in the color development process of developing the dye, the dye passing through the water-soluble ink layer 202 adheres to the medium 50. The dye passing through the water-soluble ink layer 202 means, for example, that the molecules of the dye pass through the water-soluble ink layer 202 through thermal diffusion to reach a medium during heating in the color development process. Then, in this case, the dye included in the color ink is preferably, for example, dye that easily passes through the water-soluble ink layer 202, such as dye composed of a substance with a small molecular weight. More specifically, in the printing operation illustrated in FIGS. 2A to 2E, for example, sublimation dye or disperse dye is used as the dye included in the color ink. Such a configuration enables the dye to appropriately pass through the water-soluble ink layer 202, for example, in the color development process.

Figure 2C:
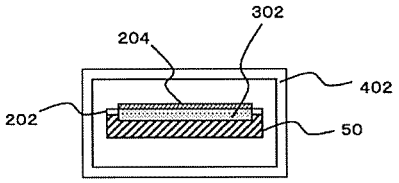

More specifically, in the color development process, for example, as illustrated in FIG. 2C, the color development process is performed using a color developer 402 that constitutes the printing system together with the printing device 10 (see FIGS. 1A and 1B). In this case, the operation of performing the color development process is an example of the operation of the color development step of developing the dye. In this example, the color developer 402 is a heating device that heats a medium 50 having the water-soluble ink layer 202 and the color ink layer 204 and accommodates the medium 50 in the inside to heat the medium 50 at a preset temperature. For example, a known oven for a color development process for dye can be suitably used as the color developer 402.

Figure 2D:
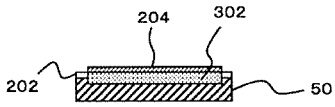

In this example, the color developer 402 heats the medium 50 having the water-soluble ink layer 202 and the color ink layer 204 to disperse and develop the dye included in the color ink layer 204 (disperse and develop the heated dye). The developed dye thus passes through the water-soluble ink layer 202 and adheres to the medium 50. In this case, the developed dye disperses, for example, as illustrated in the figure, to form a color-developed region 302 including the water-soluble ink layer 202 and part of the medium 50. In this case, the color-developed region 302 refers to, for example, a region including the developed dye. Then, in this case, the medium 50 taken out of the color developer 402 after the color development process is in a state in which part of the medium 50 is colored, for example, as illustrated in FIG. 2D.

In this example, the medium 50 taken out of the color developer 402 after the color development process is subjected to a washing process. This removes the water-soluble ink layer 202 from the medium 50. The washing process may be performed, for example, by immersing the medium 50 in hot water. The washing process may be performed, for example, in a washing portion (not illustrated) configured as part of the printing system. In this example, the color ink layer 204 formed on the water-soluble ink layer 202 is further removed by removing the water-soluble ink layer 202. Removing the color ink layer 204 means, for example, removing, of substances forming the color ink layer 204, those left on the water-soluble ink layer 202 even after the color development process. In this case, the dye adhering to the medium 50 through the color development process remains adhering to the medium 50 even after the washing process. In this example, the operation of performing a washing process is an example of the operation of the water-soluble ink layer removing step of removing the water-soluble ink layer 202. This washing process may be considered as, for example, an example of the process of removing by dissolving the water-soluble ink layer 202 serving as an undercoat layer.

Figure 2E:
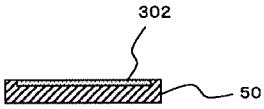

Such a washing process can appropriately remove the other components including the water-soluble ink layer 202, for example, with the dye necessary for coloring the medium 50 kept adhering on the medium 50. The medium 50 is thus colored appropriately, for example, without leaving unnecessary components on the medium 50, while contamination of the surface of the medium 50 and deterioration of surface roughness are prevented. More specifically, in this case, for example, as illustrated in FIG. 2E, the medium 50 subjected to the washing process has the color-developed region 302 in the vicinity of the surface of the medium 50, and the surface is in a colored state.

Here, when dye is used for coloring, part of the dye used may not be developed appropriately even by performing the color development process. In such a case, if the dye not developed is left on the medium 50, the surface of the medium 50 may give the impression of being coarse. By contrast, in this example, in the washing process of removing the water-soluble ink layer 202, the water-soluble ink layer 202 is removed together with the dye not adhering to the medium 50. In this case, for example, the dye not developed thus can be removed appropriately. This example therefore can prevent, for example, the effect of the undeveloped dye on the impression (for example, texture) of the medium 50 when printing is finished. For example, high-quality printing using dye thus can be performed appropriately.

When printing is performed as described above, for example, fabric medium 50 not subjected to pretreatment can be printed appropriately while bleeding is prevented. Therefore, in this case, for example, even when the fabric that the user has at hand is used as the medium 50, high-quality printing can be performed appropriately. In this respect, sublimation transfer printing has been known as a method capable of printing on various media. However, this method usually involves transfer, which possibly increases the running costs and the apparatus costs. In this case, applying pressure during transfer may cause the surface roughness of the transfer medium (transfer paper) to be transferred to the target. As a result, the desired quality of printing may not be achieved. By contrast, this example performs direct printing appropriately on, for example, fabric medium 50 without transferring. This can also prevent the occurrence of various problems involved with transferring.

The printing operation in this example may be considered as, for example, the operation of forming the color ink layer 204 on the water-soluble ink layer 202 for coloring in a state different from when an image is drawn directly on the medium 50 only with color ink. This configuration can be considered to perform various printing using the water-soluble ink layer 202 that is a layer not to be left on the medium 50 after finishing of printing.

In the printing operation described above, a fabric medium is mainly used as a medium 50. However, in light of performing a variety of printing, for example, media other than fabrics may be used as a medium 50. More specifically, in this case, for example, transfer paper, which is a medium such as paper to be colored with dye, or various plastic media (for example, plastic films) may be used. Examples of such media may include interior fabrics, curtains, and cover sheets and materials thereof. In this case, a sheet-like or plate-like medium 50 as well as a three-dimensional object such as a molded product may be used as a medium 50. More specifically, for example, a three-dimensional medium 50 may be used for printing on three-dimensional molded products such as toys, smartphone covers, and the like. A cylindrical or polygonal object related to other various products may be used as a medium 50 for printing for decoration (decorative printing). In this case, a specific configuration of the printing device 10 may be modified as appropriate according to the shape and the like of the medium 50 to be used.

FIGS. 3A to 3D are diagrams illustrating a modification of the printing operation. FIGS. 3A to 3D schematically illustrate operation in each step during printing. The printing operation illustrated in FIGS. 3A to 3D is the same or similar as the printing operation illustrated in FIGS. 2A to 2E, except for the points described below. More specifically, the operation illustrated in FIGS. 3A to 3C may be performed similarly as the operation illustrated in FIGS. 2A to 2C, except for the points described below.

Figure 3A:
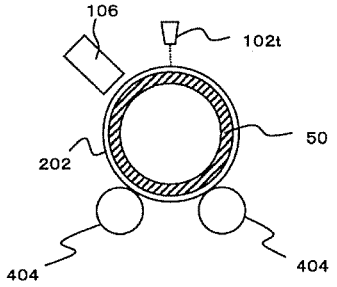
FIGS. 3A to 3D are diagrams illustrating a modification of the printing operation and schematically illustrate operation in each step during printing.

In this modification, for example, a cylindrical medium is used as a medium 50. For example, a plastic medium can be suitably used as such a medium 50. In this case, the sub scanning operation is performed by rotating the medium 50, rather than conveying the medium 50 in a predetermined conveyance direction. More specifically, in this case, for example, as illustrated in FIG. 3A, a roller 404 is used to rotate the medium 50 for driving in the sub scanning operation. For example, a KEBAB medium holder manufactured by Mimaki Engineering Co., Ltd. can be suitably used for such a configuration. In this case, it is preferable that the inkjet heads, the UV light sources, and the like in the printing device 10 (see FIGS. 1A and 1B) be positioned so as to eject ink or emit ultraviolet rays to the rotating cylindrical medium 50.

Figure 3B:
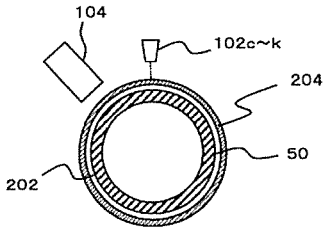
Figure 3C:
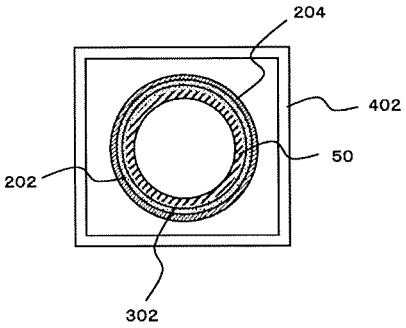
Figure 3D:
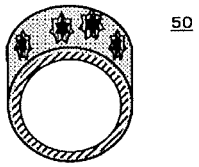

In this case, for example, as illustrated in FIG. 3A, the water-soluble ink layer 202 is formed on a medium 50 using the inkjet head 102*t* and the UV light source 106. In this case, forming the water-soluble ink layer 202 on a medium 50 means, for example, forming the water-soluble ink layer 202 on a side surface of the cylindrical medium 50, as illustrated in the figure. After the water-soluble ink layer 202 is formed, for example, as illustrated in FIG. 3B, the color ink layer 204 is formed on the water-soluble ink layer 202 using the inkjet heads 102*c* to 102*k* and the UV light source 104. Then, after the color ink layer 204 is formed, for example, as illustrated in FIG. 3C, a color development process is performed using the color developer 402. After the color development process is performed, the medium 50 taken out of the color developer 402 is subjected to a washing process in the same manner as in the printing operation described with reference to FIGS. 2A to 2E. The water-soluble ink layer 202 is thus removed from the medium 50. In this case, the medium 50 subjected to the washing process has a colored surface, for example, as illustrated in FIG. 3D.

Also in such a configuration, for example, in the color development process, the dye passes through the water-soluble ink layer 202 to appropriately color the medium 50. The washing process removes the water-soluble ink layer 202, for example, to appropriately remove the undeveloped dye. Therefore, with such a configuration, for example, high-quality printing using dye can be performed appropriately.

An example of the printing operation using sublimation dye or disperse dye as dye has mainly been described above. In this case, for example, water-soluble clear ink is used as the water-soluble ink layer 202, and heating is performed in the color development process to develop the dye appropriately. In this case, since the molecular weight of the dye is small, the dye can pass through the water-soluble ink layer 202 more appropriately. In a modification of the printing operation, dye other than sublimation dye or disperse dye may be used as a colorant included in the color ink. For example, reactive dye or acid dye may be used as such a dye. In this case, it is preferable that the water-soluble ink layer 202 and/or the color development process be modified as appropriate according to the characteristics of the dye to be used.

More specifically, for example, when reactive dye is used as the dye, the water-soluble ink layer 202 may be formed using water-soluble ink (for example, clear ink) including an auxiliary (color development auxiliary) for developing the reactive dye. In the color development process, a steam heating process may be performed, in which heating is performed with supply of steam, rather than merely performing heating. When various dyes are used as the colorant included in the color ink, the water-soluble ink layer 202 can be considered as, for example, a layer that serves some function during the color development process. In this case, serving some function during the color development process means, for example, serving some function for developing the dye. In this case, the water-soluble ink for forming the water-soluble ink layer 202 preferably includes a chemical (treatment agent, auxiliary, etc.) for developing the dye, as necessary, depending on the dye included in the color ink as a colorant.

In the printing operation described above, the water-soluble ink layer 202 is formed on the medium 50, and the color ink layer 204 is formed thereon. However, the order in which the water-soluble ink layer 202 and the color ink layer 204 are formed may be reversed. For example, when reactive dye or acid dye is used as a colorant included in the color ink, it may be preferable that the color ink layer 204 be formed on the medium 50 prior to the water-soluble ink layer 202.

FIGS. 4A to 4G are diagrams illustrating a further modification of the printing operation. FIGS. 4A to 4G schematically illustrate operation in each step during printing. The printing operation illustrated in FIGS. 4A to 4G is the same or similar as the printing operation illustrated in FIGS. 2A to 2E or FIGS. 3A to 3D, except for the points described below.

In this modification, for example, reactive dye is used as a colorant in the color ink for forming the color ink layer 204. Ink including an auxiliary (color development auxiliary) helping color development of the dye included in the color ink is used as the water-soluble ink (for example, water-soluble clear ink) for forming the water-soluble ink layer 202. In this case, the auxiliary is an example of the substance for color development for use in the color development process. Also in this modification, for example, a fabric medium (for example, cloth) is used as the medium 50. The medium 50 is not limited to a fabric medium and may be, for example, a plastic medium.

Figure 4A:
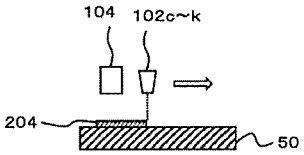
FIGS. 4A to 4G are diagrams illustrating a further modification of the printing operation and schematically illustrate operation in each step during printing.
Figure 4B:
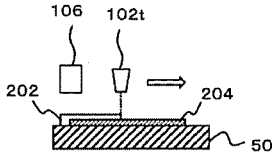
Figure 4C:
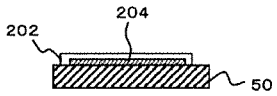

In this modification, the operation of the color ink layer forming step is performed prior to the water-soluble ink layer forming step, so that the color ink layer 204 is formed on the medium 50 before the water-soluble ink layer 202 is formed. In this case, for example, as illustrated in FIG. 4A, the color ink layer 204 is formed on a medium 50 using the inkjet heads 102*c* to 102*k* and the UV light source 104. Then, after the color ink layer 204 is formed on the medium 50, for example, as illustrated in FIG. 4B, the water-soluble ink layer 202 is formed on the color ink layer 204 using the inkjet head 102*t* and the UV light source 106. When the operation in the printing device 10 (see FIGS. 1A and 1B) is finished, for example, as illustrated in FIG. 4C, the color ink layer 204 and the water-soluble ink layer 202 are formed in an overlapped manner on the medium 50.

Figure 4D:
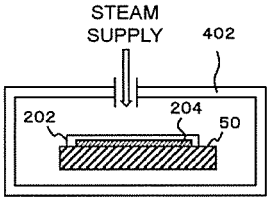
Figure 4E:
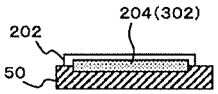

After the water-soluble ink layer 202 and the color ink layer 204 are formed on the medium 50, a color development process is performed using the color developer 402. In this modification, for example, as illustrated in FIG. 4D, a steam heating process is performed as a color development process, in which heating is performed with supply of steam. In this case, for example, an oven capable of supplying steam can be suitably used as the color developer 402. With such a configuration, for example, when reactive dye is used as dye, the dye in the color ink layer 204 reacts with the auxiliary in the water-soluble ink layer 202, so that the dye is developed appropriately. In this case, in the medium 50 taken out of the color developer 402 after the color development process, for example, as illustrated in FIG. 4E, the color-developed region 302 spreads to the vicinity of the surface of the medium 50, and the surface of the medium 50 is in a colored state.

Figure 4F:
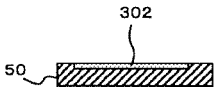
Figure 4G:
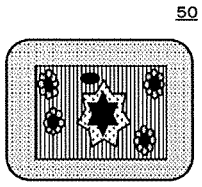

Also in this modification, after the color development process is performed, for example, the water-soluble ink layer 202 is removed through the washing process. Also in this case, the washing process may be performed, for example, by immersing the medium 50 in hot water. For example, as illustrated in FIG. 4F, the dye adhering to the medium 50 is left in the medium 50 after the washing process, and a color-developed region 302 is formed in the vicinity of the surface of the medium 50. As a result, the medium 50 subjected to the washing process has a colored surface, for example, as illustrated in FIG. 4G. When the printing operation is performed in this way, the water-soluble ink layer 202 can be used as a layer having the function of developing the dye. For example, high-quality printing using dye thus can be performed appropriately. Also in this case, forming the water-soluble ink layer 202 enables printing, for example, in a state different from forming only the color ink layer 204. In this modification, for example, various printing can be performed appropriately.

In this modification, in the washing process of removing the water-soluble ink layer 202, for example, the components of the color ink layer 204, excluding the dye adhering to the medium 50, are removed together with the water-soluble ink layer 202. In this case, water-soluble ink may be used also as the color ink for forming the color ink layer 204. The color ink being water-soluble means, for example, that the components of the color ink layer 204 excluding the dye adhering to the medium 50 is water-soluble.

In this modification, the water-soluble ink layer 202 may be considered as, for example, an example of the overcoat layer formed on the color ink layer 204. In this modification, the ink (for example, clear ink) ejected from the inkjet head 102*t* is an example of water-soluble ink including an auxiliary. Ink other than clear ink may be used as the water-soluble ink for forming the water-soluble ink layer 202. Reactive dye has been mainly described above as the dye used in this modification. However, also in this modification, various dyes can be used as the dye. For example, acid dye may be used as the dye included in the color ink. Sublimation dye or disperse dye may be used in the same manner as in the case described with reference to FIGS. 2A to 2E.

Supplementary remarks related to the configurations described above will now be given. First of all, the additional effects achieved by the configurations described above will be described. As described above, when the printing operation is performed as in the configurations above, for example, the users themselves can perform printing using dye (dyeing) on a fabric medium 50 not subjected to pretreatment. This eliminates the need for using a device for transfer or requesting pretreatment on the medium 50 from professionals, thereby significantly reducing the manufacturing cost for prints, for example, compared with printing by conventional methods. In addition, the production time can be reduced. In this case, as described above, various media 50 can be used. More specifically, any media 50 susceptible to inkjet printing can be used. For example, not only a planar medium 50 but also a three-dimensional medium 50 such as a molded product can be used.

In this case, the use of fast-drying ink as the color ink for forming the color ink layer 204 prevents bleeding and enables vibrant and high-speed printing. In this case, since ink is directly heated by radiation of energy rays such as ultraviolet rays, temperature increase of the medium 50 can be suppressed. In this case, since ink is not indirectly heated by heating the medium 50 but ink is directly heated, the effect of heating on the inkjet head can be prevented. More specifically, for example, problems such as nozzle clogging are prevented or reduced.

When we focus on the features other than ink to be used in the printing operation in FIGS. 2 to 4, for example, ink other than fast-drying ink may be used as the color ink used as textile dye ink. For example, depending on the desired quality of printing, evaporation-drying ink other than fast-drying ink may be used as color ink. For example, UV curable ink may be used as the color ink. For example, a UV curable ink diluted with water (for example, water-soluble UV-curable textile dye ink) or a UV curable ink diluted with a solvent (organic solvent) (solvent-diluted UV ink, solvent UV ink) may be used.

It is preferable that the color ink be selected according to the medium 50 to be used or the application of printing. For example, the dye included in the color ink is not limited and may be selected from various dyes including sublimation dyes, reactive dyes, acid dyes, synthetic dyes, and natural dyes, depending on specific conditions of printing. The color of ink to be used is also not limited.

Ink other than fast-drying ink may be used as the water-soluble ink for forming the water-soluble ink layer 202. For example, evaporation-drying ink other than fast-drying ink or UV curable ink may be used as the water-soluble ink. Unlike the color ink layer 204, the water-soluble ink layer 202 is formed of a single kind of ink and therefore less susceptible to problems if it takes long to fix the ink. Thus, the water-soluble ink for forming the water-soluble ink layer 202 is likely to be selected from inks other than fast-drying ink.

As described above, ink suitable for the dye included in the color ink can be used as the water-soluble ink for forming the water-soluble ink layer 202. More specifically, when the dye included in the color ink is sublimation dye, clear ink that does not include an auxiliary can be used as the water-soluble ink for forming the water-soluble ink layer 202. When dye (for example, reactive dye and acid dye) that requires an auxiliary for color development and a treatment agent is used as the dye included in the color ink, ink including a chemical such as an auxiliary (for example, auxiliary ink or treatment agent ink) may be used. Also in this case, transparent clear ink that does not include a colorant can be suitably used as the ink including a chemical such as an auxiliary. For example, ink that includes a substance similar to the pretreatment agent for use in pretreatment for the medium 50 (pretreatment agent ink) may be used as such a water-soluble ink.

The water-soluble ink layer 202 is water-soluble in a state in which it is fixed to the medium 50, for example, by drying. For example, when fast-drying ink is used for the water-soluble ink for forming the water-soluble ink layer 202, a paste and other substances that do not cure (UV cure) by ultraviolet rays may be used singly or in combination. More specifically, for example, a water-soluble acrylic UV-curable paste, a soluble polyvinyl alcohol (PVA)-based UV-curable paste, starch, sodium alginate, CMC (sodium carboxymethyl cellulose), an acrylamide paste, and a maleic acid copolymer-based paste can be used as the water-soluble ink for forming the water-soluble ink layer 202.

In the printing operation described above, the water-soluble ink layer 202 is formed at each position of the medium 50 and after a while the color ink layer 204 is formed, or the color ink layer 204 is formed at each position of the medium 50 and after a while the water-soluble ink layer 202 is formed. However, in a further modification of the printing operation, for example, ejection of color ink by the inkjet heads 102*c* to 102*k* and ejection of the water-soluble ink by the inkjet head 102*t* may be performed almost simultaneously for each position of the medium 50. In this case, for example, a layer of ink serving as both the color ink layer 204 and the water-soluble ink layer 202 is formed on the medium 50. Also in such a configuration, for example, the color development process and the washing process are performed subsequently to appropriately perform coloring (textile dyeing) on the medium 50.

INDUSTRIAL APPLICABILITY

The present disclosure can be suitably used for, for example, printing methods.

What is claimed is:

1. A printing method of performing a printing process on a medium using a color ink, the color ink being an ink having a color, the printing method comprising:

a water-soluble ink layer forming step of forming a water-soluble ink layer, the water-soluble ink layer being a layer of ink that becomes water-soluble after fixing;

a color ink layer forming step of ejecting the color ink to the medium to form a layer of the color ink; and a water-soluble ink layer removing step of removing the water-soluble ink layer, wherein the color ink includes a colorant and a solvent, and the color ink generates heat by radiation of an energy ray, and the heat generated due to the radiation of the energy ray is performed by absorbing the energy ray irradiated to an energy absorber contained in the color ink, in the color ink layer forming step, the energy ray is emitted to the color ink after ink droplets landing to generate the heat, and at least a part of the solvent included in the color ink is evaporated and removed to a degree that the color ink after landing is without bleeding, wherein the energy ray is an ultraviolet ray, the energy absorber is an ultraviolet ray absorber, the ultraviolet ray absorber is a substance that exhibits a large absorption of emission wavelengths of the ultraviolet ray, in the color ink layer forming step, an integrated value of a radiation energy of the ultraviolet ray is 300 to 3000 $mJ/cm^2$, when the layer of the color ink is formed by 20 μm-thick of the color ink, an absorption ratio of ultraviolet ray is 10% or more.

2. The printing method according to claim 1, wherein the color ink is the ink including a dye as the colorant, the dye being developed through a color development process, and the printing method further comprising:

a color development step of developing the dye through the color development process, before the water-soluble ink layer is removed in the water-soluble ink layer removing step.

3. The printing method according to claim 2, wherein in the color ink layer forming step, the color ink is ejected onto the water-soluble ink layer, and in the color development step, the dye passing through the water-soluble ink layer adheres to the medium.

4. The printing method according to claim 3, wherein the color ink includes one of a sublimation dye and a disperse dye as the dye.

5. The printing method according to claim 3, wherein in the water-soluble ink layer removing step, the water-soluble ink layer is removed together with the dye not adhering to the medium.

6. The printing method according to claim 2, wherein a layer of the color ink is formed in the color ink layer forming step, before the water-soluble ink layer is formed in the water-soluble ink layer forming step, in the water-soluble ink layer forming step, the water-soluble ink layer is formed on the layer of the color ink, an ink to be used for forming the water-soluble ink layer includes a substance for color development that is a substance for use in the color development process, in the color development step, the substance for color development is used to develop the dye, and the water-soluble ink layer is removed in the water-soluble ink layer removing step, after the dye is developed in the color development step.

7. The printing method according to claim 1, wherein a fabric medium is used as the medium.

8. The printing method according to claim 1, wherein the color ink is an ink that generates heat by radiation of the ultraviolet ray, and in the color ink layer forming step, the ultraviolet ray is emitted as the energy ray.

9. A printing device configured to perform a printing process on a medium using a color ink, the color ink being an ink having a color, the printing device comprising:

a water-soluble ink layer-former, configured to form a water-soluble ink layer, the water-soluble ink layer being a layer of ink that becomes water-soluble after fixing; and a color ink layer-former, configured to eject the color ink to the medium to form a layer of the color ink, wherein the water-soluble ink layer is a layer of ink to be removed before the printing process is finished, wherein the printing process includes: forming the water-soluble ink layer, forming the layer of the color ink, and removing the water-soluble ink layer, the color ink includes a colorant and a solvent, and the color ink generates heat by radiation of an energy ray, and the heat generated due to the radiation of the energy ray is performed by absorbing the energy ray irradiated to an energy absorber contained in the color ink, the color ink layer-former emits the energy ray to the color ink after ink droplets landing to generate the heat, and at least a part of the solvent included in the color ink is evaporated and removed to a degree that the color ink after landing is without bleeding, wherein the energy ray is an ultraviolet ray, the energy absorber is an ultraviolet ray absorber, the ultraviolet ray absorber is a substance that exhibits a large absorption of emission wavelengths of the ultraviolet ray, an integrated value of a radiation energy of the ultraviolet ray is 300 to 3000 mJ/cm$^2$, when the layer of the color ink is formed by 20 μm-thick of the color ink, an absorption ratio of ultraviolet ray is 10% or more.

10. A printing system configured to perform a printing process on a medium using a color ink, the color ink being an ink having a color, the printing system comprising:

a water-soluble ink layer-former, configured to form a water-soluble ink layer, the water-soluble ink layer being a layer of ink that becomes water-soluble after fixing; and a color ink layer-former, configured to eject the color ink to the medium to form a layer of the color ink, wherein the water-soluble ink layer is a layer of ink to be removed before the printing process is finished, wherein the printing process includes: forming the water-soluble ink layer, forming the layer of the color ink, and removing the water-soluble ink layer, the color ink includes a colorant and a solvent, and the color ink generates heat by radiation of an energy ray, and the heat generated due to the radiation of the energy ray is performed by absorbing the energy ray irradiated to an energy absorber contained in the color ink, the color ink layer-former emits the energy ray to the color ink after ink droplets landing to generate the heat, and at least a part of the solvent included in the color ink is evaporated and removed to a degree that the color ink after landing is without bleeding, wherein the energy ray is an ultraviolet ray, the energy absorber is an ultraviolet ray absorber, the ultraviolet ray absorber is a substance that exhibits a large absorption of emission wavelengths of the ultraviolet ray, an integrated value of a radiation energy of the ultraviolet ray is 300 to 3000 mJ/cm$^2$, when the layer of the color ink is formed by 20 μm-thick of the color ink, an absorption ratio of ultraviolet ray is 10% or more.

11. A printing method of performing a printing process on a medium using a color ink, the color ink being an ink having a color and including a colorant, the printing method comprising:

a water-soluble ink layer forming step of forming a water-soluble ink layer, the water-soluble ink layer being a layer of ink that becomes water-soluble after fixing;

a color ink layer forming step of ejecting the color ink to the medium to form a layer of the color ink on the water-soluble ink layer;

a color development step of developing the colorant included in the color ink; and a water-soluble ink layer removing step of removing the water-soluble ink layer, wherein the color ink including a dye as the colorant, the dye being developed through a color development process, and in the color development step, the dye is developed through the color development process, and the dye passing through the water-soluble ink layer adheres to the medium, before the water-soluble ink layer is removed in the water-soluble ink layer removing step, and a heat generated due to a radiation of an energy ray is performed by absorbing the energy ray irradiated to an energy absorber contained in the color ink, in the color ink layer forming step, the energy ray is emitted to the color ink after ink droplets landing to generate the heat, and at least a part of a solvent included in the color ink is evaporated and removed to a degree that the color ink after landing is without bleeding, wherein the energy ray is an ultraviolet ray, the energy absorber is an ultraviolet ray absorber, the ultraviolet ray absorber is a substance that exhibits a large absorption of emission wavelengths of the ultraviolet ray, in the color ink layer forming step, an integrated value of a radiation energy of the ultraviolet ray is 300 to 3000 mJ/cm$^2$, when the layer of the color ink is formed by 20 μm-thick of the color ink, an absorption ratio of ultraviolet ray is 10% or more.

12. A printing device configured to perform a printing process on a medium using a color ink, the color ink being an ink having a color and including a colorant, the printing device comprising:

a water-soluble ink layer-former, configured to form a water-soluble ink layer, the water-soluble ink layer being a layer of ink that becomes water-soluble after fixing; and a color ink layer-former, configured to eject the color ink to the medium to form a layer of the color ink on the water-soluble ink layer, wherein the color ink including a dye as the colorant, the dye being developed through a color development process, the water-soluble ink layer is a layer of ink to be removed before the printing process is finished, wherein the printing process includes: forming the water-soluble ink layer, forming the layer of the color ink, the color development process, and removing the water-soluble ink layer, the dye included in the color ink is subjected to the color development process by a color developer, and the color developer develops the dye through the color development process and allows the dye passing through the water-soluble ink layer to adhere to the medium, before the water-soluble ink layer is removed, and a heat generated due to a radiation of an energy ray is performed by absorbing the energy ray irradiated to an energy absorber contained in the color ink, the energy ray is emitted to the color ink after ink droplets landing to generate the heat, and at least a part of a solvent included in the color ink is evaporated and removed to a degree that the color ink after landing is without bleeding, wherein the energy ray is an ultraviolet ray, the energy absorber is an ultraviolet ray absorber, the ultraviolet ray absorber is a substance that exhibits a large absorption of emission wavelengths of the ultraviolet ray, an integrated value of a radiation energy of the ultraviolet ray is 300 to 3000 mJ/cm$^2$, when the layer of the color ink is formed by 20 μm-thick of the color ink, an absorption ratio of ultraviolet ray is 10% or more.

13. A printing system configured to perform a printing process on a medium using a color ink, the color ink being an ink having a color and including a colorant, the printing system comprising:

a water-soluble ink layer-former, configured to form a water-soluble ink layer, the water-soluble ink layer being a layer of ink that becomes water-soluble after fixing;

a color ink layer-former, configured to eject the color ink to the medium to form a layer of the color ink on the water-soluble ink layer; and a color developer, configured to develop the colorant included in the color ink, wherein the color ink including a dye as the colorant, the dye being developed through a color development process, the water-soluble ink layer is a layer of ink to be removed before the printing process is finished, wherein the printing process includes: forming the water-soluble ink layer, forming the layer of the color ink, the color development process, and removing the water-soluble ink layer, and the color developer develops the dye through the color development process and allows the dye passing through the water-soluble ink layer to adhere to the medium, before the water-soluble ink layer is removed, a heat generated due to a radiation of an energy ray is performed by absorbing the energy ray irradiated to an energy absorber contained in the color ink, the energy ray is emitted to the color ink after ink droplets landing to generate the heat, and at least a part of a solvent included in the color ink is evaporated and removed to a degree that the color ink after landing is without bleeding, wherein the energy ray is an ultraviolet ray, the energy absorber is an ultraviolet ray absorber, the ultraviolet ray absorber is a substance that exhibits a large absorption of emission wavelengths of the ultraviolet ray, an integrated value of a radiation energy of the ultraviolet ray is 300 to 3000 mJ/cm$^2$, when the layer of the color ink is formed by 20 μm-thick of the color ink, an absorption ratio of ultraviolet ray is 10% or more.

* * * * *